US008360351B2

(12) United States Patent
Dixon et al.

(10) Patent No.: US 8,360,351 B2
(45) Date of Patent: Jan. 29, 2013

(54) MULTI-SECTIONAL ROLLER MILL

(76) Inventors: Graham Dixon, Newcastle Upon Tyne (GB); Thomas Wilkinson, Gateshead (GB)

( * ) Notice: Subject to any disclaimer, the term of this patent is extended or adjusted under 35 U.S.C. 154(b) by 275 days.

(21) Appl. No.: 12/681,168

(22) PCT Filed: Jan. 29, 2008

(86) PCT No.: PCT/GB2008/050058

§ 371 (c)(1),
(2), (4) Date: Jul. 26, 2010

(87) PCT Pub. No.: WO2009/044179

PCT Pub. Date: Apr. 9, 2009

(65) Prior Publication Data

US 2010/0282883 A1 Nov. 11, 2010

(30) Foreign Application Priority Data

Oct. 5, 2007 (GB) ..... 0719426.9

(51) Int. Cl.
*B02C 4/42* (2006.01)

(52) U.S. Cl. ..... 241/129; 241/131; 241/160

(58) Field of Classification Search ..... 241/124, 241/129, 131, 160
See application file for complete search history.

(56) References Cited

U.S. PATENT DOCUMENTS

2007/0170291 A1 7/2007 Naganawa

FOREIGN PATENT DOCUMENTS

| | | |
|---|---|---|
| DE | 26907 C | 1/1920 |
| DE | 325029 | 9/1920 |
| EP | 0029734 | 6/1981 |
| EP | 0110535 | 6/1984 |
| FR | 2853566 | 10/2004 |
| GB | 189409739 | 4/1895 |
| GB | 311329 | 8/1930 |
| GB | 355249 | 8/1931 |
| GB | 471523 | 12/1936 |
| GB | 1324158 | 7/1973 |
| GB | 331877 | 7/1980 |
| GB | 2178675 | 2/1987 |
| GB | 2187658 | 9/1987 |
| JP | 05096197 | 4/1993 |
| JP | 10211443 | 8/1998 |
| JP | 2005125168 | 5/2005 |
| WO | WO 2006/064483 | 6/2006 |
| WO | WO 2007/065214 | 6/2007 |

*Primary Examiner* — Mark Rosenbaum
(74) *Attorney, Agent, or Firm* — Thomas E. Sisson

(57) ABSTRACT

A multi-sectional roller mill comprises at least two mill sections (2, 2') each including a plurality of 'rollers (20, 20'), wherein each mill section includes a-drive shaft (16, 16') and male and female parts of a coupling element (15) attached to respective ends of said drive shaft for rotation therewith, and wherein the said coupling element provides for rotation between said male and female parts of drive shafts of adjacent mill sections.

16 Claims, 10 Drawing Sheets

MULTI-SECTIONAL ROLLER MILL

FIELD OF THE INVENTION

The present invention relates to a roller mill, and in particular to a roller mill suitable for producing fine powders from hard materials.

BACKGROUND OF THE INVENTION

The present invention is concerned with a roller mill which can be used to mill material traditionally milled using ball mills. Ball mills are used widely to manufacture of powders in the cement industry and in the aluminium industry where they are used to mill bauxite, which is a particularly hard material.

Ball mills consume large amounts of energy. Typically, where a ball mill would use 80 kw/tonne to mill a material to a particular particle size, the roller mill of the present invention would use significantly less energy, perhaps as little as 4 to 5 kw/tonne.

There are certain waste materials which if milled to a sufficiently small particle size may be used in the manufacture of cementitious compositions. For example, lime stone may be incorporated in to cementitious compositions if it is reduced to a sufficiently small particle size. However, the energy consumption of a ball mill may render such reduction in particle size uneconomic. Similarly, there are products which could be used as part of a mixture to be burnt to generate power, if those products could be reduced to a sufficiently small particle size. It would therefore be advantageous to provide a mill capable of producing materials of small particle size for a modest consumption of energy.

In many instances, if these materials cannot be reduced in size economically they will be dumped in land fill sites, which incurs a cost and uses space required for materials which have no other useful purpose.

Another problem associated with ball mills particularly when miffing very hard materials, such as bauxite, is that the metal material of the balls wears leaving metal mixed with the milled product. This metal must then be extracted by passing the milled material between magnets, further increasing the cost of production.

A roller mill is known from GB 331877. In this mill grinding rolls are arranged to rotate about a vertical axis and to engage with a ring. The rollers are mounted on swinging arms, which are provided with biasing means to force the rollers against the ring before the centrifugal action of the mill comes into full effect. The product to be milled is delivered to the rollers by a feeder apparatus which rotates with the mill and is arranged to deposit product ahead of the rollers.

A multi-stage roller mill is known from Bulgarian patent no 37402 which includes three roller mills arranged in series and is provided with classifying means to remove particles of a size within a defined range between each milling stage.

A multi-stage mill is also known from Japanese Patent number 5096197. In this multi-stage roller mill a plurality of sets of rollers are mounted in a housing on a drive shaft common to each set. The roller mill described mills particles of solid substances which are entrained in a slurry. In addition to milling the solid particles the action of the roller mill ensures that solid particles are well dispersed in the slurry.

Roller mills of the prior art are not designed to mill hard substances, such as bauxite. However, in comparison to ball mills, roller mills use considerably less energy.

It would therefore be desirable to provide an improved roller mill.

SUMMARY OF THE INVENTION

According to a first aspect of the invention there is provided a multi-sectional roller mill comprising at least two mill sections, wherein each mill section includes a drive shaft and male and female parts of a coupling element attached to respective ends of said drive shaft for rotation therewith, wherein a male part attached to one drive shaft engages with a female part attached to another drive shaft, and wherein the said coupling element provides for drive shafts of adjacent mill sections to be driven by the same drive and by different drives.

The male part may comprise a plurality of rollers and the female part may comprise an annular channel, wherein the rollers facilitate relative rotation between the male and female parts if the drive shafts of respective mill sections are to be driven at different speeds.

According to a second aspect of the invention there is provided a multi-sectional roller mill comprising at least two mill sections, wherein the rollers of each mill section and a wall element of each mill section are adapted to provide a lead-in to an interface between a roller surface of said roller and a rolling surface of the wall element.

The edges of the rollers and wall element may comprise chamfered edges which together provide the lead-in. Advantageously, at least the rolling surface of the wall element is hardened. Further, the rolling surface of each roller may be hardened.

Each mill section may include a spreader plate arranged above the rollers to deliver material to the interface between the rollers and the rolling surface of the wall. Preferably, the spreader plate is arranged to deliver material to the said lead-in.

According to a third aspect of the invention there is provided a multi-sectional roller mill comprising at least two mill sections, wherein the walls of each mill section comprise at least three wall elements, and wherein one of the wall elements includes a rolling surface for engagement of rollers thereon, and wherein the wall elements are stackable one on top of the other, the said wall elements including means to restrict lateral movement of one wall element relative to another.

The upper and lower wall elements of each mill section may support a bearing housing, wherein a bearing located in the housing supports the drive shaft of the mill section.

Advantageously, the means to restrict lateral movement of one wall element relative to another comprises corresponding rebates in the end faces of adjacent wall elements, wherein the rebate of one wall element engages with the rebate of the adjacent wall element.

By configuring the wall in a number of wall elements, each wall element may be made from the most suitable material, for example the working life of the rolling surface of the wall element engaged by the rollers of the mill may be enhanced by hardening thereof. However, there is no need to harden those parts of the wall which support the drive shafts. Further, by configuring the wall in a number of wall elements, assembly, disassembly and repair of the mill sections is simplified, as walls of the mill section and the inner working elements of the mill section may be built up at the same time.

According to a fourth aspect of the invention there is provided a multi-sectional roller mill wherein each mill section is separable from the other mill sections and wherein each mill section is provided with elements for engagement by a lifting apparatus. This provides the advantage that the mill sections may be removed easily from other mill sections, for example in a situation where one of the mill sections has malfunctioned that mill section may be removed and replaced with another mill section which is in good order.

The said elements for engagement by a lifting apparatus may comprise brackets extending outwardly from each side of a mill section. Preferably, the said brackets are each configured to receive a fork of a forklift truck. More preferably, where the wall is comprised of a plurality of wall elements, the uppermost wall element of each mill section is provided with said lifting apparatus. This arrangement no only allows for the easy movement of one mill section from another, but also provides for the upper wall element of a mill section to be lifted off the wall element to which is it attached by the same lifting apparatus.

According to a fifth aspect of the invention there is provided a multi-section roller mill comprising a first drive and a second drive, wherein at least one mill section is driven by the first drive and at least one mill section is driven by the second drive, and wherein the first and second drive may be arranged to drive respective mill sections at different speeds.

The ability to drive different mill sections at different speeds is advantageous. For example, when milling very hard products and where fine particles are required, it may not be possible to produce particles of the required size by passing the material once through the mill. With such materials, to achieve a desired particle size, it has been found that the least energy is expended by reducing the material to a first size with the first mill section which may be driven at a relatively low speed, and then reducing the material to particles of a desired size by passing them through an adjacent mill section operating at a greater speed than the first mill section. In fact, it has been found that such an arrangement gives better results than passing the material through a single mill section twice, with the single mill section operating at the same first and second speeds for the first and second passage through the mill section.

According to a sixth aspect of the invention there is provided a multi-sectional roller mill including a feeder unit, wherein the feeder unit includes at least two product inlets and means to mix the at least two products prior to introduction thereof into the first mill section of the multi-sectional roller mill.

Another aspect of the invention provides a method of reducing the size of particulate material comprising the step of passing said material through a multi-sectional roller mill according to any one or more of the aspects of the invention set out above.

BRIEF DESCRIPTION OF THE DRAWINGS

In the drawings, which illustrated preferred embodiments of a multi-sectional roller mill according to the invention, and are by way of example only.

DETAILED DESCRIPTION OF THE EMBODIMENT ILLUSTRATED IN THE DRAWINGS

Figure 1:
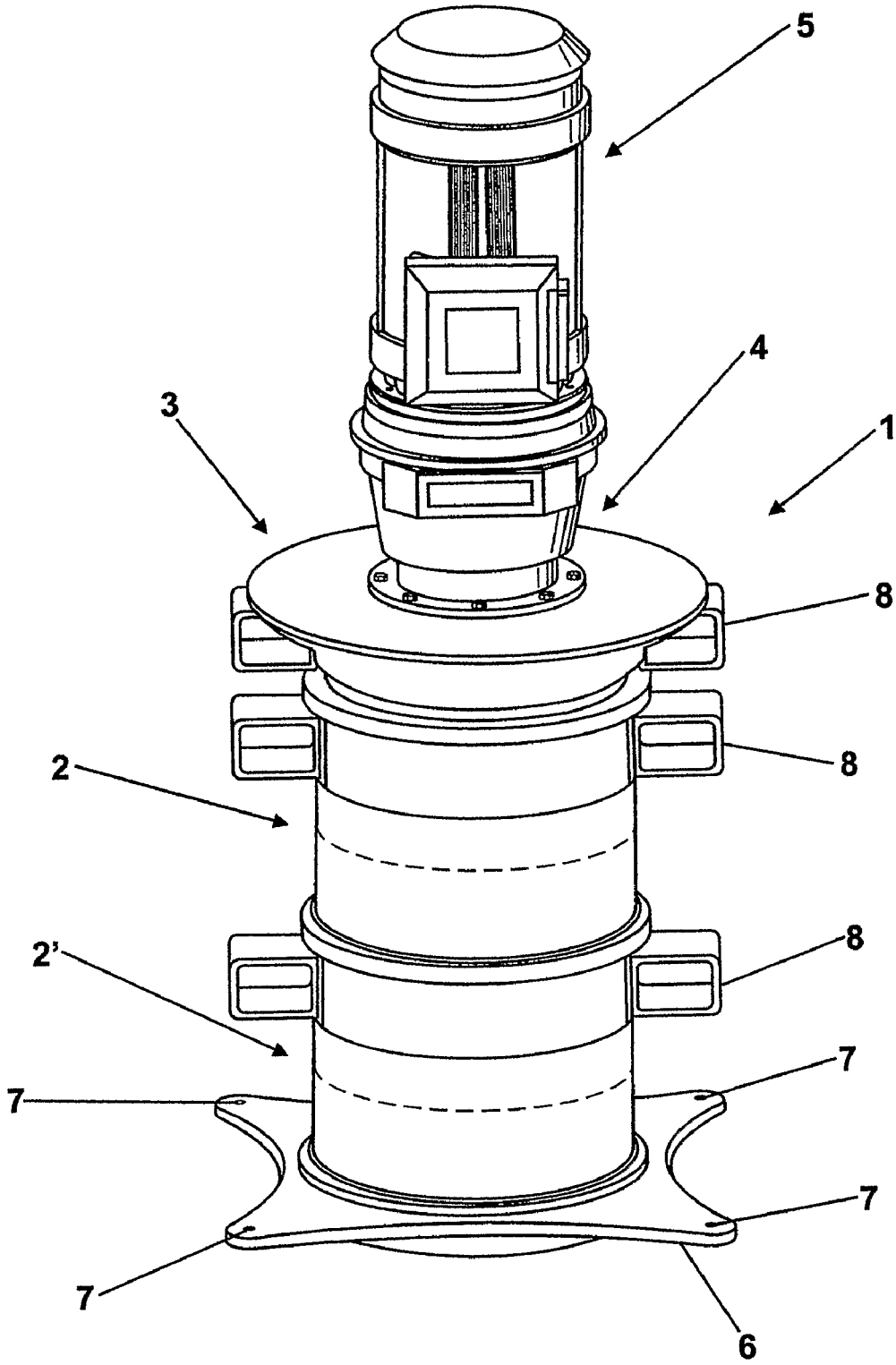
FIG. 1 is a schematic representation of a multi-sectional roller mill according to the invention.

With reference to the drawings, to the extent that the parts of the roller mill sections 2, 2' correspond for parts of the roller mill section 2' the same reference numerals are used for both mill sections except that in the case of parts of the roller mill section 2' the reference numeral is followed by an apostrophe.

Referring now to FIG. 1, the multi-sectional roller mill 1 comprises roller mill sections 2, 2', a material feeder unit 3, a drive 4 and a motor 5. The motor 5 is attached to one end of the drive 4 with the other end thereof being attached to the mill section 2. The drive 4 delivers power from the motor 5 to the mill section 2. Power is delivered from the mill section 2 to the mill section 2' via a coupling arrangement, which is described in greater below. The mill section 2' is provided with a plate 6, the corners of which include apertures 7 in order that the whole mill 1 may be secured in place by suitable fasteners. Each of the mill sections 2, 2' and the feeder unit 3 are provided with a pair of brackets 8. The dimensions of the brackets 8 are such that a standard pallet fork may be inserted into the brackets to facilitate the removal of the feeder unit 3 or one of the mill sections 2, 2' in a simple fashion.

Figure 2:
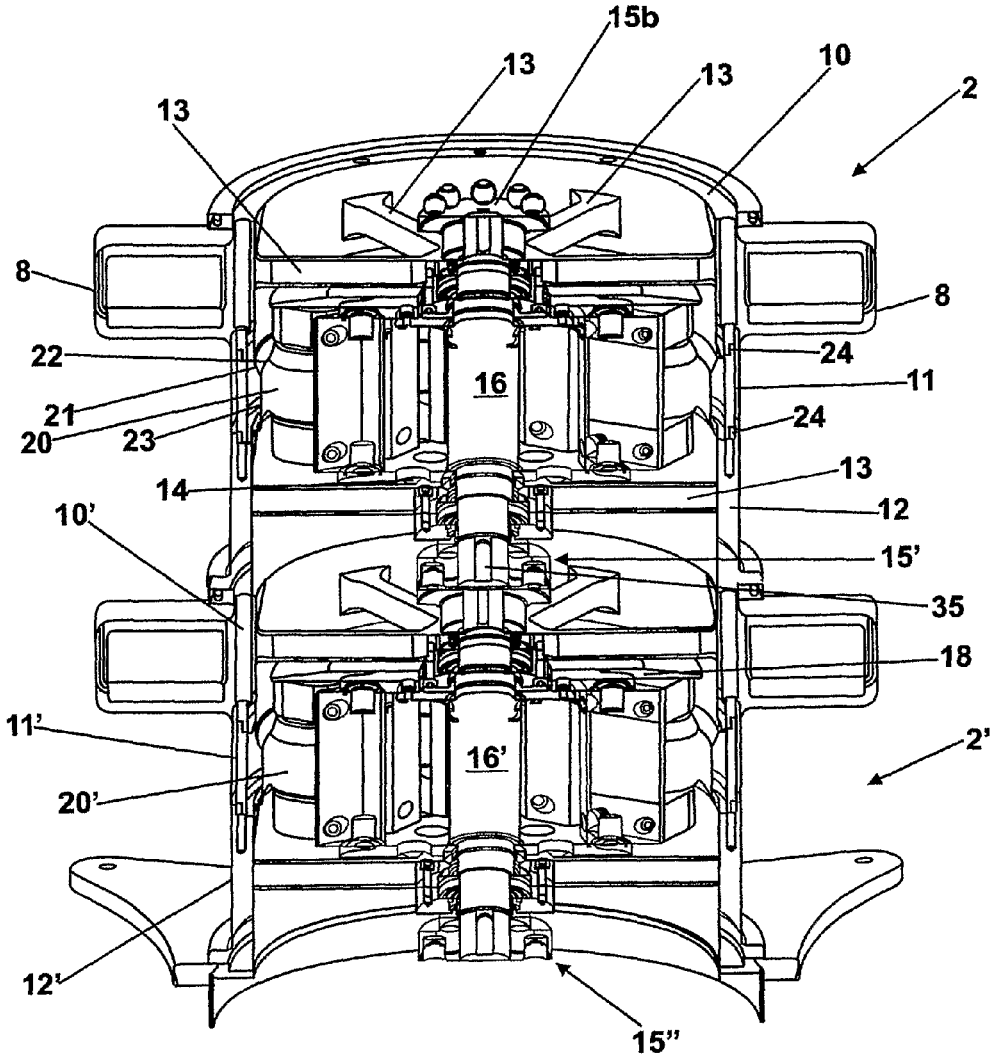
FIG. 2 is a cross-sectional elevation of two mill sections of the multi-sectional roller mill illustrated in FIG. 1.
Figure 3:
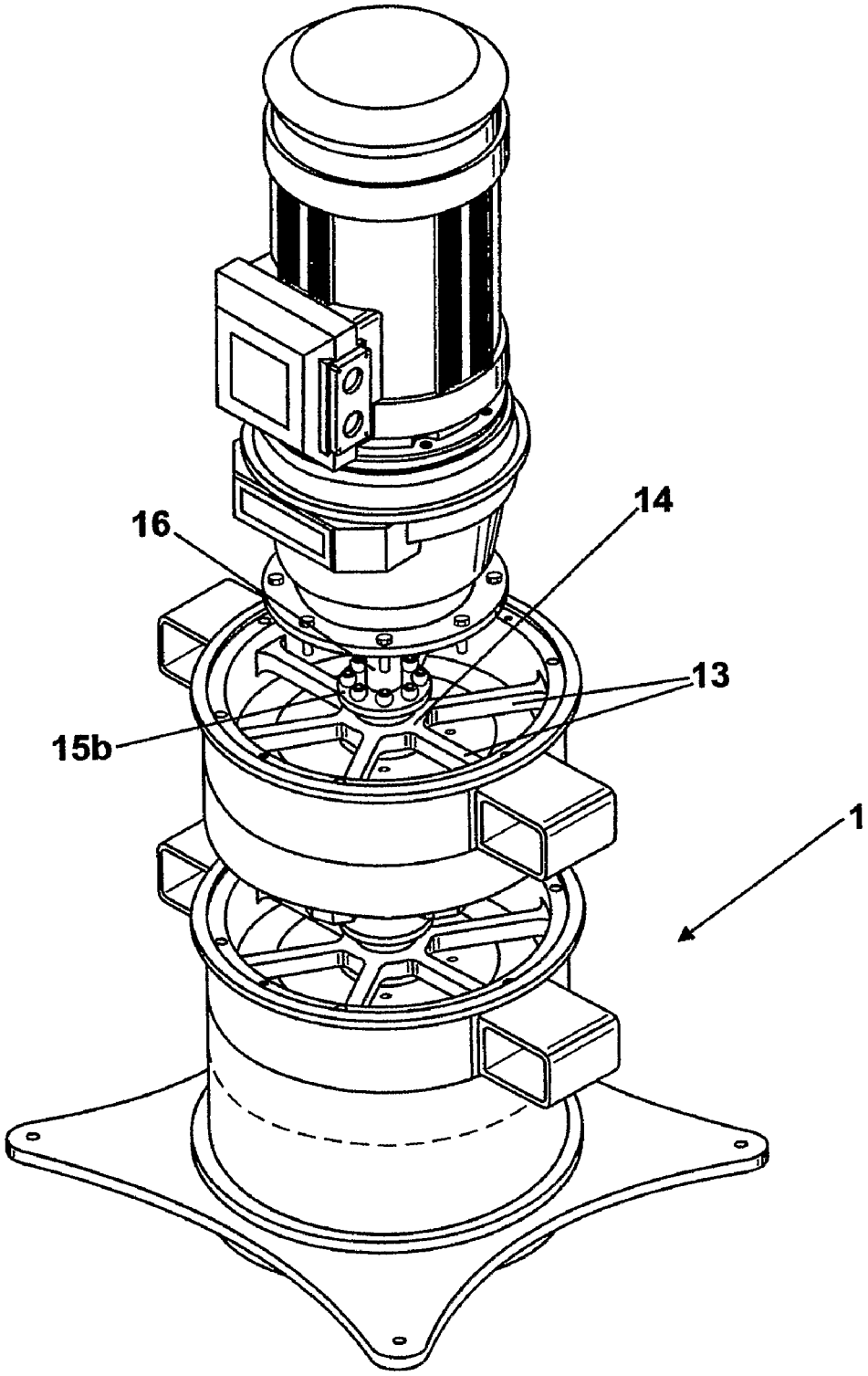
FIG. 3 is an exploded view of parts of the multi-sectional roller mill illustrated in FIG. 1.

Referring now to FIGS. 2 and 3, the outer wall of each mill section 2, 2' is comprised of upper and lower wall elements 10 and 12, and an intermediate wall element 11. The wall elements 10 and 12 each mount a bearing which itself supports a shaft 16. Extending radially inwardly from the inner surface of the wall 10 are support arms 13 which support a bearing housing 14. The lower wall element 12 corresponds substantially to the upper wall element 10 insofar as it includes support arms 13 extending inwardly from the inner surface of the wall 12 and which support a bearing housing 14.

The intermediate wall element 11 is the part of the wall which engages with the rollers 20. Preferably, at least the surface of each roller 20 which engages with the wall element 11 is hardened. As can be seen from FIG. 2, a leading edge 21 of the wall element 11 and a leading edge 22 of the rollers 20 are chamfered to form a "v" shape which leads material to be milled to the interface between the surface of the rollers 20 and the inner surface 23 of the wall element 11. It should be noted that at least the inner surface 23 of the wall element 11 is hardened, and that the intermediate wall element 11 is designed to wear through use. The upper and lower wall elements 10, 12 and the intermediate wall element 11 interlock by means of lap joints 24. The lower surface of the upper wall element 10 and the upper surface of the intermediate wall element 11 are each provided with corresponding rebates 24 (best illustrated in FIG. 5*c*). The lap joints 24 ensure the correct location of the upper wall element 10 on the intermediate wall element 11. Similarly, the lower surface of the intermediate wall element 11 and the upper surface of the lower wall element 12 are provided with corresponding rebates 24. Suitable fasteners in the form of rods 48 which extend through bores 49 extending through the walls 11, 12 and 13 are provided to prevent the wall sections 10, 11 and 12 separating from one another during operation of the mill.

Figure 4:
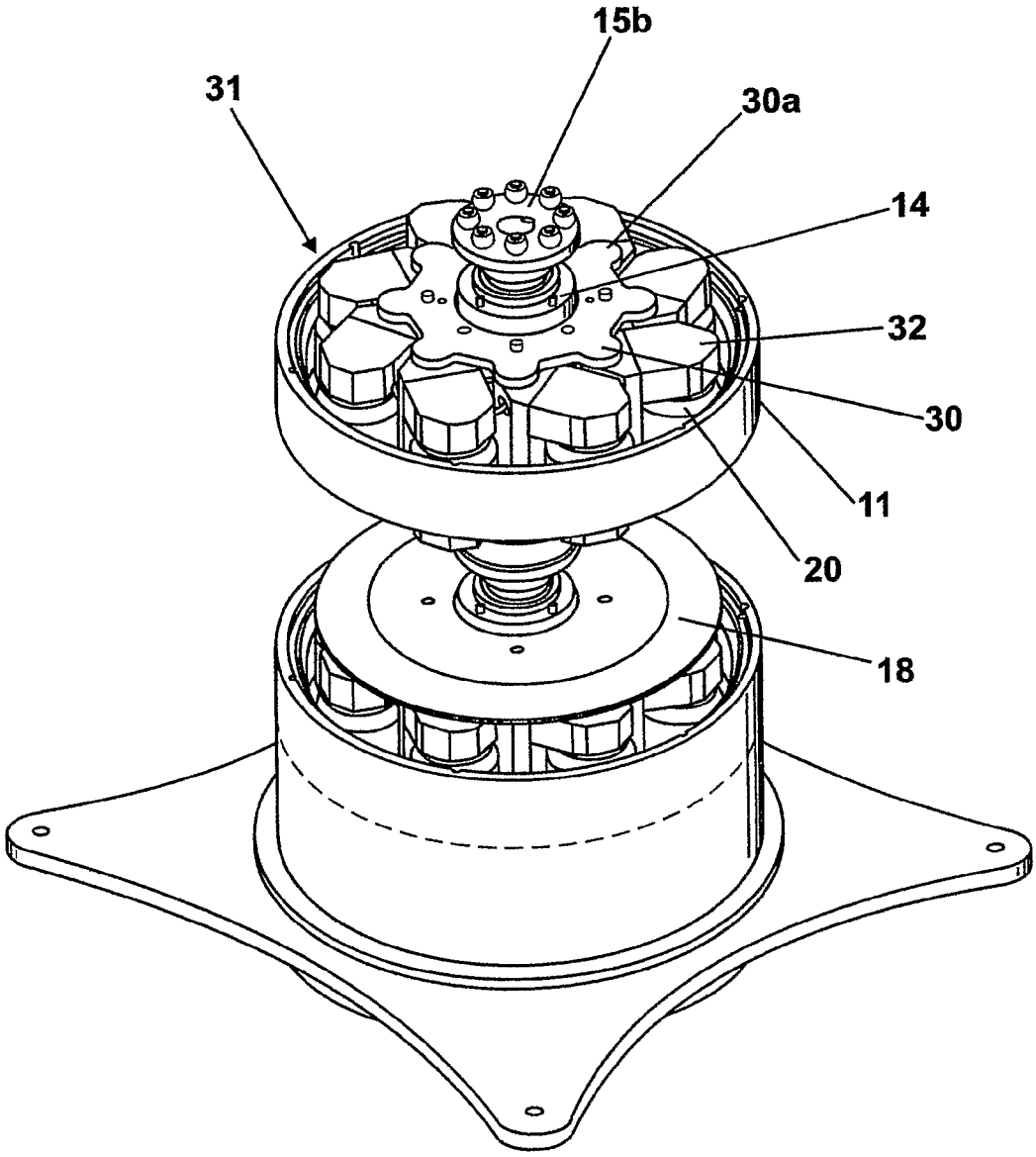
FIG. 4 illustrates parts of the mill sections of the multi-sectional roller mill illustrated in FIG. 1.
Figure 5A:
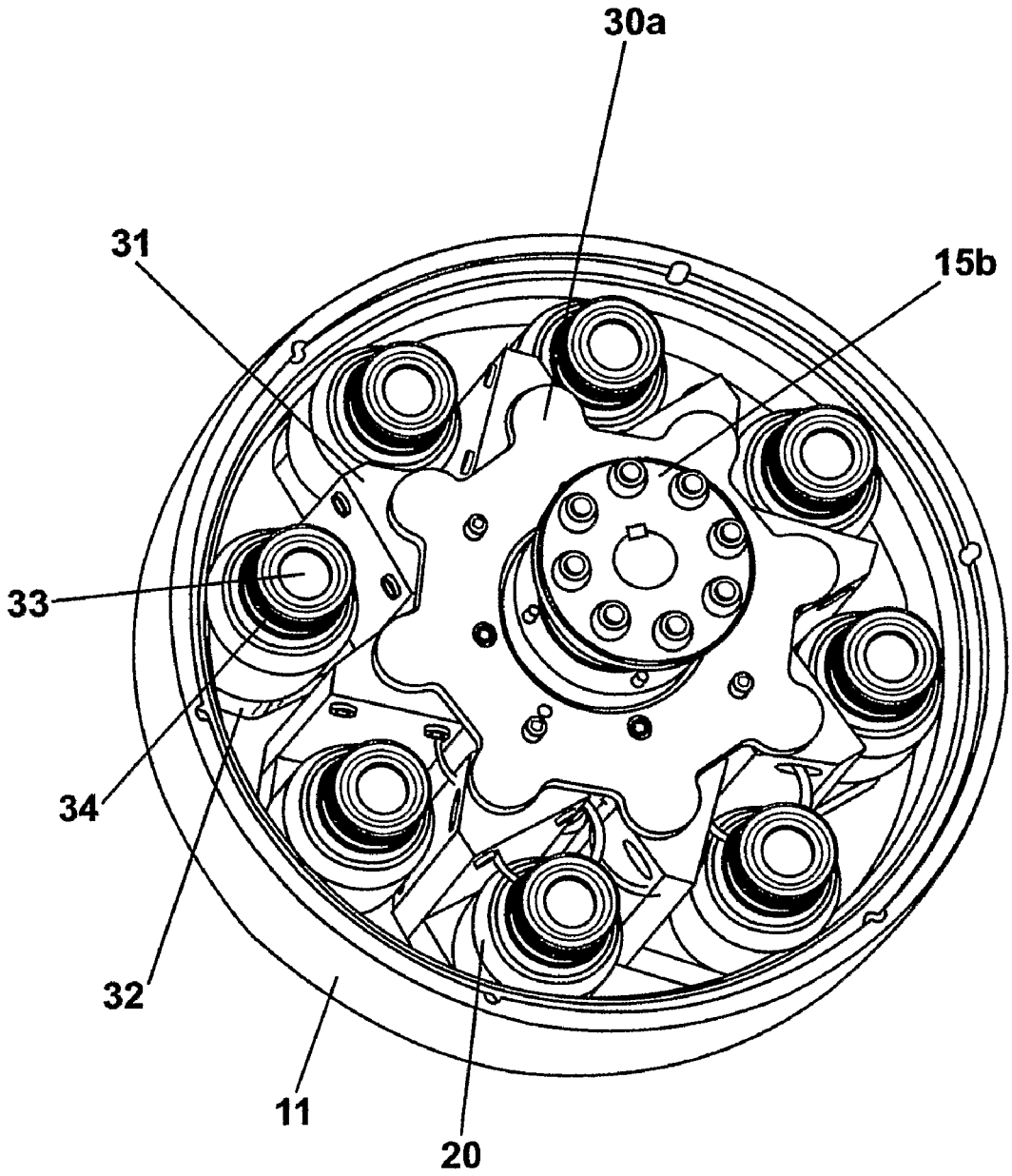
FIG. 5*a* is a schematic representation of the roller carriage of the mill illustrated in FIG. 1 with parts of the swing arms omitted.
Figure 5B:
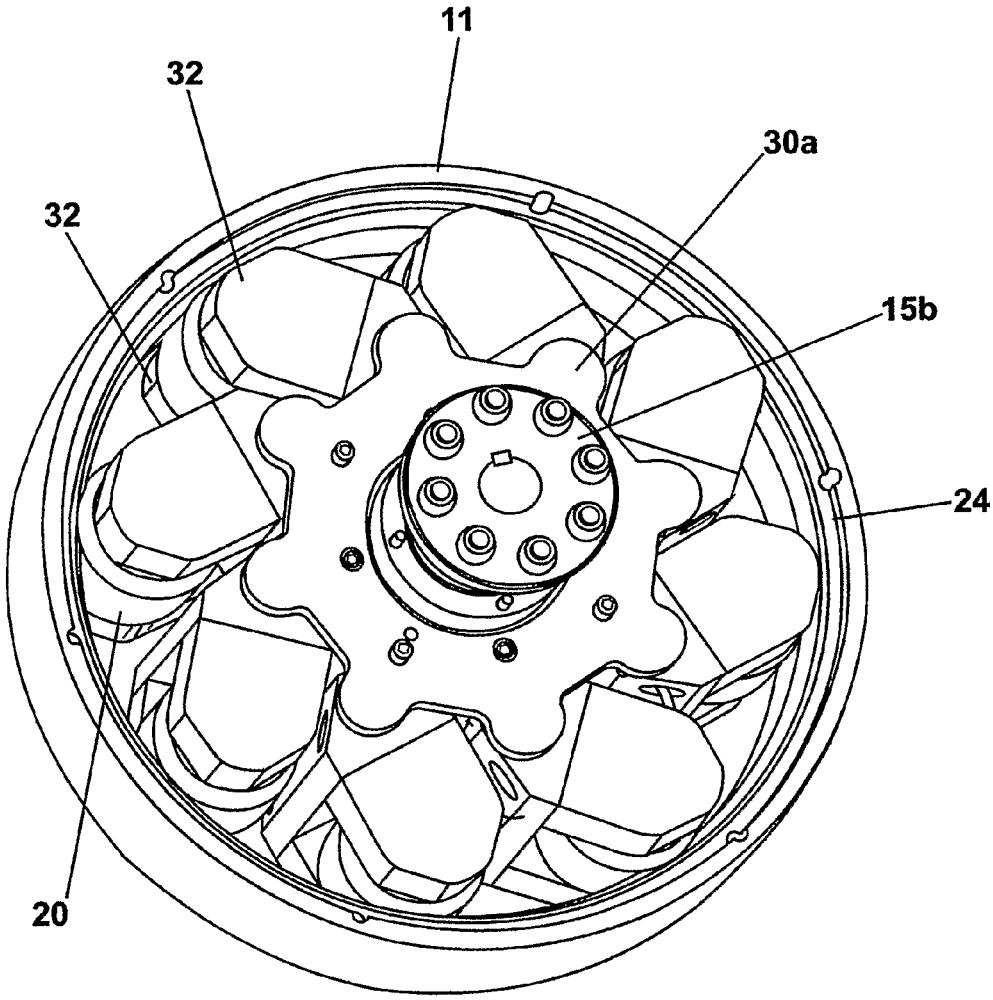
FIG. 5*b* is a schematic representation of the roller carriage of the mill illustrated in FIG. 1.
Figure 5C:
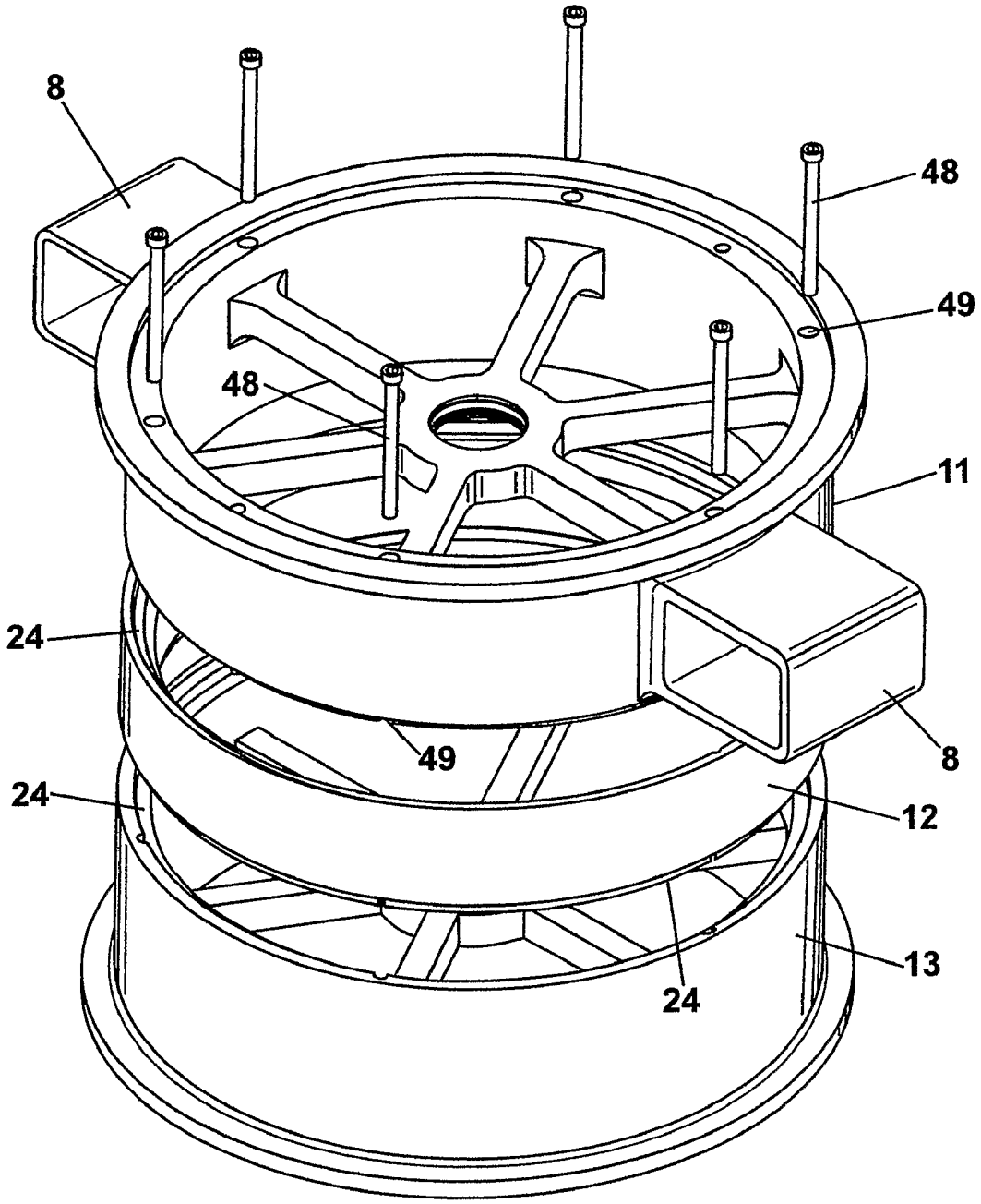
FIG. 5*c* is a schematic representation of elements of the mill illustrated in FIG. 1.

Referring now to FIGS. 4, 5*a* and 5*b* the rollers 20 are mounted on a carriage comprising upper and lower plates 30*a*, 30*b*, which mount a plurality of swing arms 31. The swing arms 31 are mounted between the upper and lower plates 30, the mounting arrangement of the swing arms 31 in the plates 30 providing for the swing arms 31 to swing freely towards and way from the intermediate wall element 11. Each swing arm 31 includes a pair of spaced apart roller mounts 32. A shaft 33 extends between the said mounts 32, the shaft 33 mounting bearings 34, each bearing being proximate a roller mount 32. To the upper plate 30*a* is attached a part 15*b* of a coupling 15, which connects the carriage to a source of rotational power, either the drive 4 or the shaft of another mill section of the multi-sectional mill, for example in FIG. 2 it can be seen that the coupling 15' of the lower mill section is attached to the shaft 16 of the upper mill section. In use, the carriage is rotated which subjects the swing arms 31 to centrifugal force, causing the said to swing about their attachment to the plates 30 until the rollers engage with the inner surface of the intermediate wall 11. As the speed of rotation of the carriage is increased, the centrifugal force on the rollers 20, and hence the force exerted on the inner surface of wall 11 by the rollers 20 increases proportionally.

As an alternative to driving the lower mill section 2' from the upper mill section 2 by means of shaft 16, the lower mill section 2' may be driven independently of the upper mill section 2. When so configured, the bottom end of shaft 16' is equipped with a coupling 15". The coupling 15" may be attached to the output of a drive similar to drive 4, or the shaft of another mill section driven by a drive independent of the drive 4. In the embodiment illustrated in FIG. 2, drive from the shaft 16 of the first mill section 2 to the shaft 16' of the second mill section 2' is interrupted by removing a key 35, which if in place would transfer power from shaft 16 to the coupling 15'. It is advantageous to be able to drive different mill sections are different speeds. For example, when miffing particularly hard materials the first section may be run at a comparatively low speed and a second section, driven independently of the first section, at a faster speed. Surprisingly, it has been found that the product resulting from passing material through the multi-stage mill of the invention with the second mill section rotating at a faster speed than the first section is better, i.e. milled to a smaller particle size, and/or a more even distribution of particle sizes, than where the same material is passed through a single stage of the mill twice, once at a low speed and subsequently at a faster speed.

Each mill section 2, 2' is provided with a spreader plate 18, the function of which is to ensure that the material to be milled is delivered to the rollers at the interface between the rollers 20, 20' and the inner surface of the wall element 11, 11'. Each spreader plate 18 is attached to the upper plate 30 of the carriage and so rotates therewith.

Figure 6:
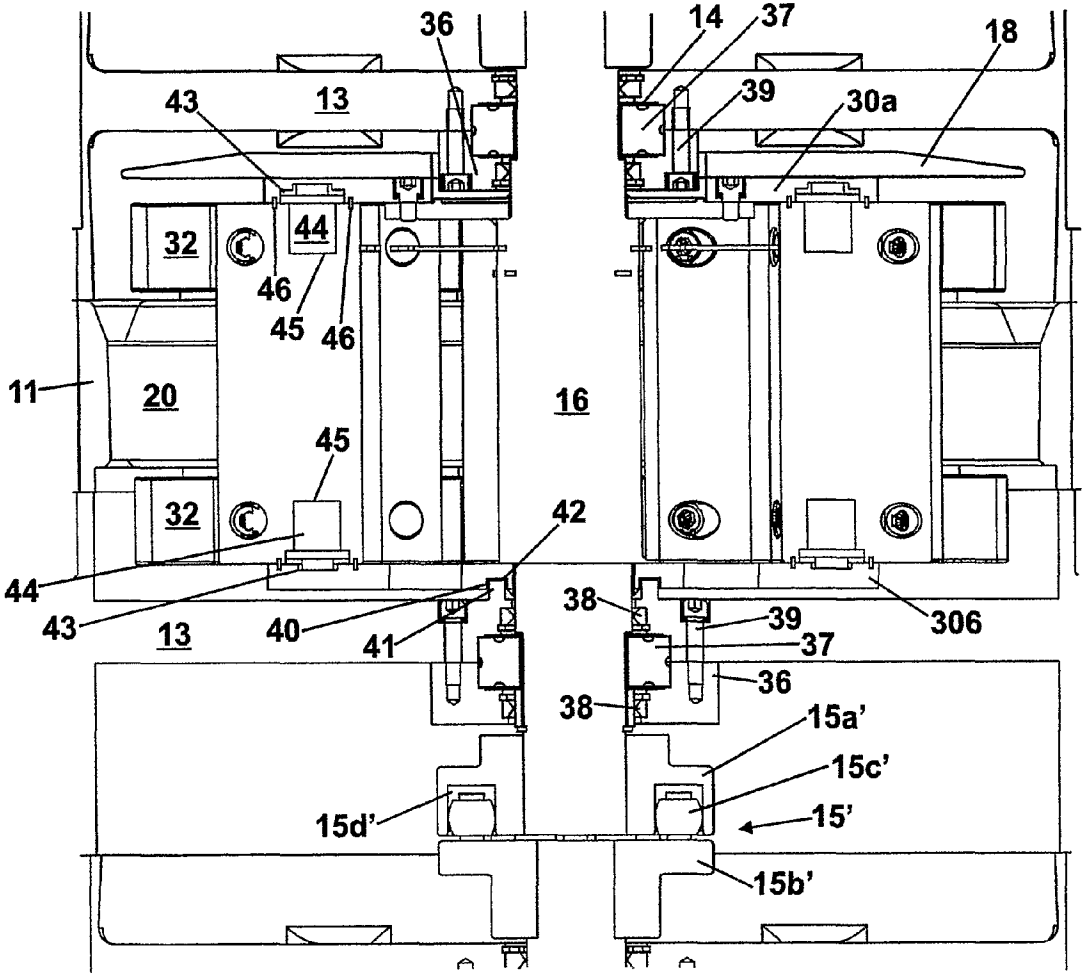
FIG. 6 is a cross-section of parts of the multi-sectional roller mill illustrated in FIG. 1.

FIG. 6 illustrates certain parts of the multi-sectional roller mill are illustrated in greater detail. The coupling 15' comprises an upper part 15*a'* and a lower part 15*b'*, the parts 15*a'* and 15*b'* being attached to respective ends of shafts 16 and 16'. The upper part 15*a'* includes an annular recess 15*d'*, and the lower part 15*b'* mounts a plurality of roller bearings 15*c'*, which lie in the annular recess 15*d'*. The coupling 15' provides for shafts 16 and 16' of adjacent mill sections to be driven independently of one another or driven together. Where the shafts 16 and 16' are driven by different power sources at different speeds the upper and lower parts 15*a'*, 15*b'* of the coupling 15' rotate with respect to one another, whereas when the shafts 16 and 16' are connected such that they are driven at the same speed there is not relative rotation between the upper and lower parts 15*a'* and 15*b'* of the coupling 15'.

The lower plate 30*b* and the bearing housing 14 include means to prevent ingress of milled material into the bearing 37, the said means comprising an annular recess 40 formed in the underside of the lower plate 30*b* and a corresponding annular element 41 projecting upwardly from the surface of the bearing housing 14 and being located in the recess 40, the sizes of the respective recess 40 and element 41 being such that a small gap 42 is formed between the element 41 and recess 40. The gap 42 is required as the lower plate 30*b* rotates with respect to the bearing housing 14. In order for milled material to come into proximity with the bearing 37 the material must pass through the tortuous path formed by the gap 42. The size of the gap 42 and its shape mean that passage of material therethrough is resisted.

Another part of the mill illustrated in FIG. 6 is plate 36 which together with bolts 39 serves to secure the bearing 37 in the bearing housing 14.

Also illustrated in FIG. 6 is the mounting arrangement for the swing arms 31, the arrangement comprising recesses 43 in the upper and lower plates 30*a*, 30*b*, pins 44 seated in bores 45 in the swing arm 31 and in the recess 43 and a seal 46 which sits in grooves formed in a surface of the swing arm 31 and the lower surface of the upper plate 30*a*. The shape of the part of the pins 44 sitting in the recesses 43 is such that a gap 47 is formed therebetween. This gap 47 is preferably filled with lubricant.

Figure 6A:
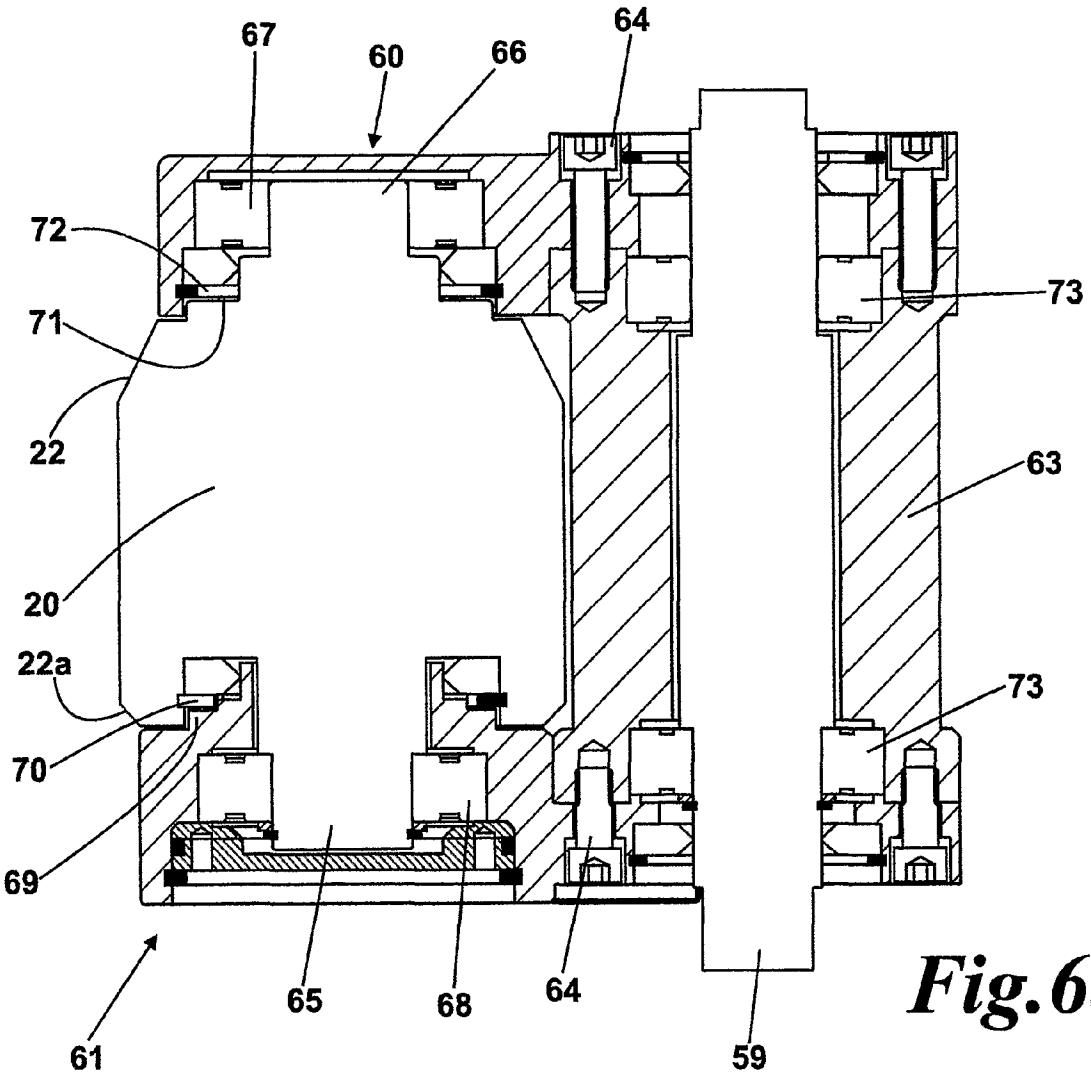
FIG. 6*a* is a cross-section of an alternative roller mounting for use in a roller mill of the invention.

Referring now to FIG. 6*a*, an alternative mounting arrangement for the swing arms which each mount a roller 20 is illustrated. Each swing arm includes a shaft 59 which is mounted between upper and lower plates 30*a*, 30*b*. The shaft 59 is located in a housing 63 by means of upper and lower bearings 73. Top and bottom roller mounts 60 and 61 are attached to the housing 63 by means of bolts 64. Bearings 67, 68 are located in the roller mounts 60 and 61 respectively, the stub-shafts 65, 66 of the roller 20 being supported in the said bearings. The upper part of the roller mount 61 and the upper part of the roller 20 each have stepped profiles 69, 71 respectively. These stepped profiles work together with seals 70, 72 to prevent dust from entering the bearings 67, 68. The provision of stepped profiles means that in order to enter the bearings dust must move upwards a number of times, which it is unlikely to do. Another aspect of the roller which is illustrated in FIG. 6*a* (but not limited to the other constructional features illustrated therein) is the lower chamfered edge 22*a*. The wearing surface of the wall element is provided with a similar chamfer. Together these lower chamfers ensure that the surfaces of the wall and the roller wear evenly.

Figure 7:
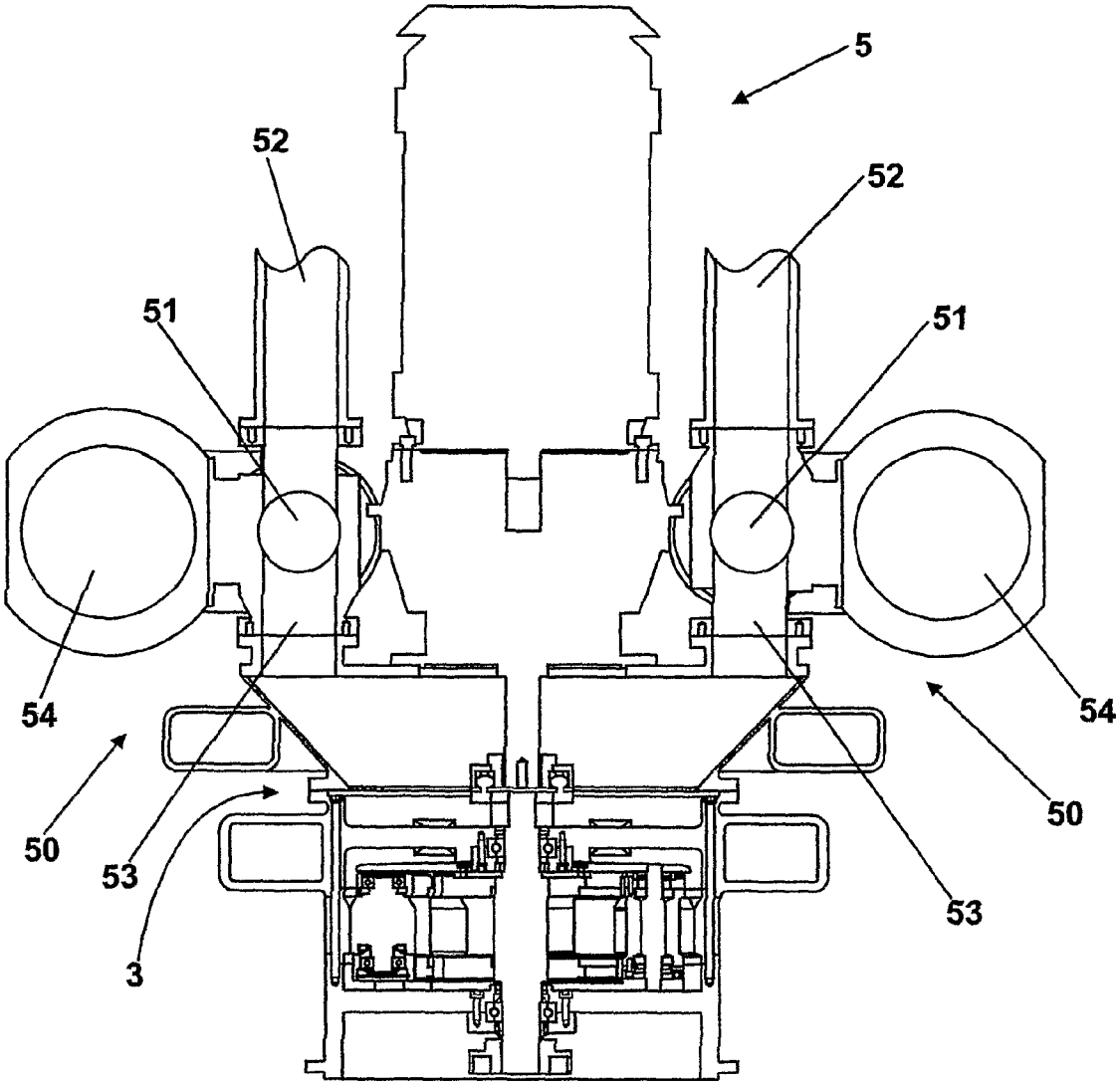
FIG. 7 is a schematic representation of a feeder unit of a multi-sectional roller mill according to the invention.

The feeder 3 unit illustrated in FIG. 7 has mounted thereon two feed inlet arrangements 50, each comprising a rotary valve 51 having an inlet connected to a pipe 52 through which material is introduced and an outlet 53, and a motor 54 which powers the rotary valve 51. The amount of material passing from the inlet 52 to the outlet 53 is controlled by the position of the rotary valve 51. Material exiting the outlet 53 debouches into the feeder unit 3. Mixing of the materials entering the mill through the two feed inlet systems 50 is mixed by the action of the spreader plate 18 and the milling action of the mill sections. The provision of more than one inlet allows materials to be mixed and mill in one operation. Further, by including a flow control, in the form of a rotary valve in the present example, the relative proportions of materials can be controlled.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise each feature disclosed is one example of a generic series of equivalent or similar features.

The invention claimed is:

1. A multi-sectional roller mill comprising at least two mill sections each including a plurality of rollers, wherein each mill section includes a drive shaft and male and female parts of a coupling element attached to respective ends of said drive shaft for rotation therewith, and wherein the said coupling element provides for rotation between said male and female parts of drive shafts of adjacent mill sections.

2. A multi-sectional roller mill according to claim 1, wherein male part comprises a plurality of rotatable elements and the female part comprises an annular channel, wherein the rotatable elements facilitate relative rotation between the male and female parts when the drive shafts of respective mill sections are driven at different speeds.

3. A multi-sectional roller mill according to claim 1, wherein the rollers of each mill section and a wall element of each mill section are adapted to provide a lead-in to an interface between a rolling surface of said roller and a rolling surface of the wall element.

4. A multi-sectional roller mill according to claim 3, wherein the edges of the rollers and wall element comprises chamfered edges which together provide the lead-in.

5. A multi-sectional roller mill according to claim 3 wherein at least the rolling surface of the wall element is hardened.

6. A multi-sectional roller mill according to claim 1, wherein at least the rolling surface of each roller is hardened.

7. A multi-sectional roller mill according to claim 1, wherein each mill section includes a spreader plate arranged above the rollers to deliver material to the interface between the rollers and the rolling surface of the wall.

8. A multi-sectional roller mill according to claim 7, wherein the spreader plate is arranged to deliver material to the said lead-in.

9. A multi-sectional roller mill according to claim 1, wherein the walls of each mill section comprise at least three wall elements, and wherein one of the wall elements includes a rolling surface for engagement of rollers thereon, and wherein the wall elements are stackable one on top of the other, said wall elements including means to restrict lateral movement of one wall element relative to another.

10. A multi-sectional roller mill according to claim 9, wherein the upper and lower wall elements of each mill section may support a bearing housing, and wherein a bearing located in the housing supports the drive shaft of the mill section.

11. A multi-sectional roller mill according to claim 9, wherein the means to restrict lateral movement of one wall element relative to another comprises corresponding rebates in the end faces of adjacent wall elements, wherein the rebate of one wall elements engages with the rebate of the adjacent wall element.

12. A multi-sectional roller mill according to claim 1, wherein each mill section is separable from the other mill sections and wherein each mill section is provided with elements for engagement by a lifting apparatus.

13. A multi-sectional roller mill according to claim 12 wherein the said elements for engagement by a lifting apparatus comprise brackets extending outwardly from each side of a mill section.

14. A multi-sectional roller mill according to claim 13, wherein the said brackets are each configured to receive a fork of a forklift truck.

15. A multi-sectional roller mill according to claim 12 wherein the wall of each mill section is comprised of a plurality of wall elements, and the uppermost wall element of each mill section is provided with said lifting apparatus.

16. A multi-sectional roller mill according to claim 1, further comprising a first drive and a second drive, wherein at least one mill section is driven by the first drive and at least one mill section is driven by the second drive, and wherein the first and second drive may be arranged to drive respective mill sections at current speeds.

* * * * *